US006745447B2

(12) United States Patent
Smith

(10) Patent No.: US 6,745,447 B2
(45) Date of Patent: Jun. 8, 2004

(54) EXTRACTOR FOR BUSHING AND ITS ASSOCIATED METHOD OF USE

(76) Inventor: John Antony Smith, 7 South Road, Templefields, Harlow, Essex, CM20 CM20 2AP (GB)

( * ) Notice: Subject to any disclaimer, the term of this patent is extended or adjusted under 35 U.S.C. 154(b) by 0 days.

(21) Appl. No.: 10/042,121

(22) Filed: Oct. 24, 2001

(65) Prior Publication Data

US 2002/0144390 A1 Oct. 10, 2002

(30) Foreign Application Priority Data

Oct. 24, 2000 (GB) ..... 0026027

(51) Int. Cl.[7] ..... B23P 19/00
(52) U.S. Cl. ..... 29/426.5; 29/259
(58) Field of Search ..... 29/426.5, 898.08, 29/259, 260, 261; 16/2.1

(56) References Cited

U.S. PATENT DOCUMENTS

| | | | | | |
|---|---|---|---|---|---|
| 1,024,147 | A | * | 4/1912 | Ripley | 29/281.1 |
| 2,170,461 | A | * | 8/1939 | Pepperdine | 29/261 |
| 3,846,898 | A | * | 11/1974 | Kerr | 29/259 |
| 3,990,139 | A | * | 11/1976 | Touchet | 29/261 |
| 4,195,398 | A | | 4/1980 | Matthews | 29/262 |
| 4,214,362 | A | | 7/1980 | Beard | |
| 4,369,569 | A | | 1/1983 | Armstrong, Jr. et al. | |
| 4,724,608 | A | * | 2/1988 | Parrott | 29/259 |
| 4,852,235 | A | * | 8/1989 | Trease et al. | 29/263 |
| 4,977,661 | A | | 12/1990 | Wood | 29/261 |
| 5,058,256 | A | | 10/1991 | Taylor et al. | 29/260 |
| 5,249,342 | A | | 10/1993 | Smith | |
| 5,251,368 | A | * | 10/1993 | Somerville et al. | 29/261 |
| 5,255,435 | A | | 10/1993 | Shultz | 29/898.08 |
| 5,735,033 | A | * | 4/1998 | Marugg | 29/261 |
| 6,223,410 | B1 | * | 5/2001 | Sroka | 29/261 |

OTHER PUBLICATIONS

Tapmatic '85, General Catalog, 1985, pp. 20 and 21.

* cited by examiner

*Primary Examiner*—David P. Bryant
(74) *Attorney, Agent, or Firm*—Schwegman, Lundberg, Woessner & Kluth, P.A.

(57) ABSTRACT

To extract a bushing from a housing, a number of cylindrical engaging elements are inserted in the bore of the bushing. The elements are clipped together by clips and have a lip which bears on the bushing end surface. An extractor head pushes on the elements to force the bushing from the housing.

17 Claims, 6 Drawing Sheets

EXTRACTOR FOR BUSHING AND ITS ASSOCIATED METHOD OF USE

RELATED APPLICATION

This application claims priority under 35 U.S.C. 119 from United Kingdom Application Serial No. 0026027.3, filed Oct. 24, 2000, which application is made a part hereof by reference.

BACKGROUND OF THE INVENTION

The present invention relates to an extractor for bearings, bushings, sleeves, liners, and the like.

FIELD OF THE INVENTION

Many methods of extracting bearings, bushings, sleeves, liners and the like (hereinafter referred to generally as bushings) which are an interference fit in a housing often result in damage to the bushing and/or the housing.

Using a simple drift to drive out the bushing will score the housing and deform the end of the bushing. It also requires access to both ends of the housing.

Various pulling methods have been proposed.

U.S. Pat. No. 4,214,362 and U.S. Pat. No. 4,369,569 describe a tube puller in which an extractor cam forces gripping surfaces against the bushing inside wall, damaging the bushing and also risking distortion of the housing wall.

U.S. Pat. No. 5,249,342 describes an extractor which can be operated from one end of the housing. A cam is inserted through the bushing, followed by a collet. The collet has a number of legs and these are urged outwards by the cam to a predetermined diameter as the cam is withdrawn. Lips on the legs engage the distal end of the bushing so that the cam, collet and bushing are withdrawn together. Accurate sizing of the collet and cam ensure that there is no distortion of the bushing and no scoring of the housing surface, avoiding any need to repair or dress the housing, and allowing re-use of the bushing when appropriate. However, the collets are expensive to manufacture, and the collet/cam assembly must be tailored to a particular bushing internal diameter.

SUMMARY OF THE INVENTION

A first aspect of the present invention provides an engaging device for engaging an end of a bushing prior to extraction of the collet and bushing from a housing, the device comprising a plurality of engaging elements each having a laterally extending lip thereon, and means for releasably connecting the elements together.

Preferably, the connected elements form a chain which is flexible to allow the chain to be rolled up for insertion in a bushing, and unrolled to place the elements against the bushing inner surface. In use, the engaging elements are arranged inside the bushing, with the lips extending behind the bushing end surface. An extractor then applies a removal force to the engaging elements to force the elements and bushing from the housing.

By releasably connecting the engaging elements together, the number of elements can be varied to suit the diameter of the bushing being extracted. The elements may be clipped together, preferably by clips which each engage two adjacent elements, forming a chain or bandolier.

To remove a bushing, a chain of elements is formed into a spiral or otherwise collapsed and inserted into the bushing. The spiral is expanded out to a broken loop or circle to engage the lips of the engaging elements behind the distal end of the bushing. An extraction tool can then bear on the ends of the elements to pull the elements and bushing from the housing.

A former can be passed into the ring of engaging elements to urge them against the bushing, ensuring that the lips sit snugly on the end of the bushing as the elements are extracted with the bushing.

When the extraction is made from one end only of the housing, the extraction tool may be fed through the bushing before the engaging elements are put in place, or it may be provided with a collapsible claw which can be opened out after it has been fed through the elements and the former.

Thus, the invention provides a system which can be adapted to fit a wide range of bushing diameters by changing the number of engaging elements and/or the spacing between the elements. Engaging elements of different size may also be provided, smaller sizes being more suited to extracting smaller diameter bushings.

The lip on an engaging element is sized to bear on the end of the bushing and carry the force of the extraction tool to the bushing. The lip is dimensioned to stop short of the housing surface to avoid any scarring of the surface. Preferably the lip is formed at an end of the engaging element, the body of the element extending within the bushing.

BRIEF DESCRIPTION OF THE DRAWINGS

The invention will be further described by way of example with reference to the accompanying drawings, in which.

DETAILED DESCRIPTION

Figure 1A:
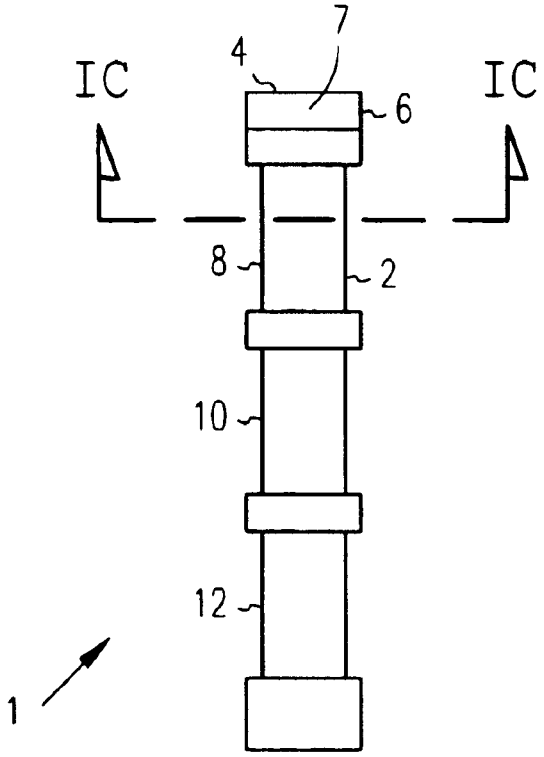
FIGS. 1*a* and 1*b* are plan and side views of an engaging element forming a first embodiment of the invention and FIG. 1*c* is a cross section along the line Ic—Ic of FIG. 1*a;*
Figure 1B:
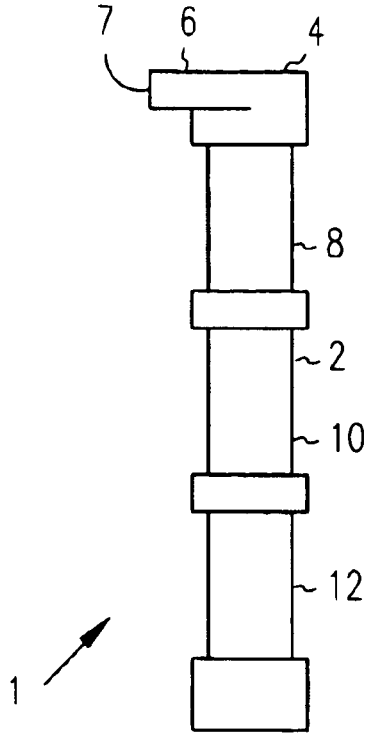
Figure 1C:
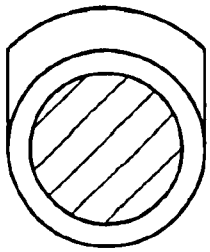
Figure 5:
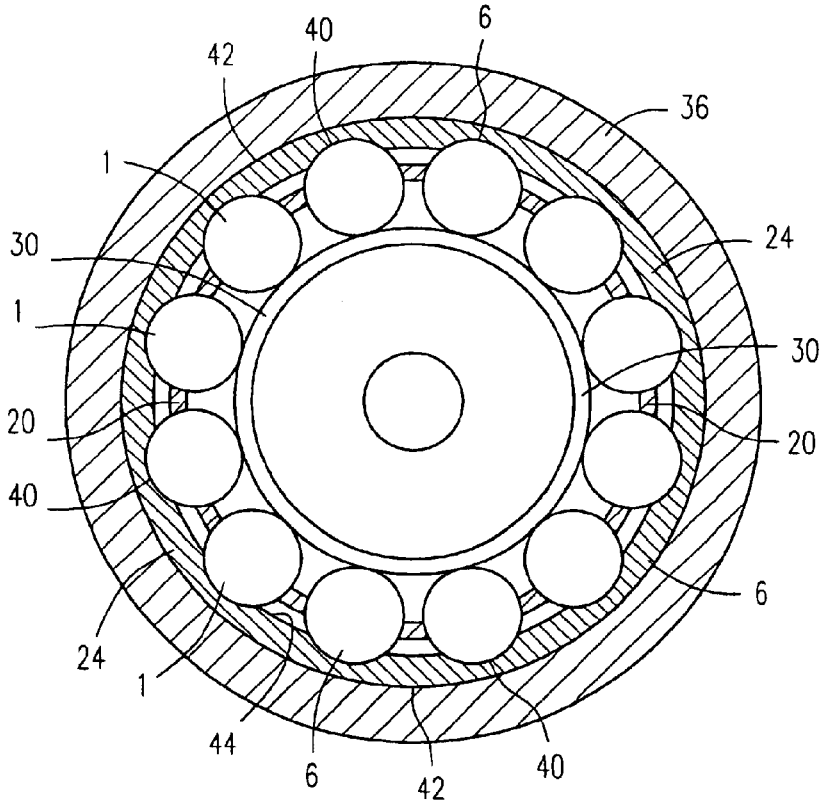
FIG. 5 is a view on line V—V of FIG. 4.

Referring to FIGS. 1*a* and 1*b*, an engaging element 1 is formed by a generally circular cross-section, cylindrical, solid pin 2 of toughened steel, such as EN56. At one end 4 of the pin 2 a lip 6 is integrally formed. The outer edge 7 of the lip 6 extends across the width of the pin and subtends an angle of about 60 degrees at the centre axis of the pin, as seen in FIG. 5. The lip 6 is concentric at its outer edge 7 with the pin body. The lip 6, has a depth X which is preferably about 85% of thickness of the wall of bushing to be extracted. Where the bushing has a smaller wall thickness, due to its design or through wear, a lip could be ground down to suit, pins with a smaller lip provided.

The pin 2 has three reduced diameter regions 8, 10, 12 for receiving clips 14 to clip engaging elements 1 together, as will be described with reference to FIGS. 2 and 3.

Figure 3:
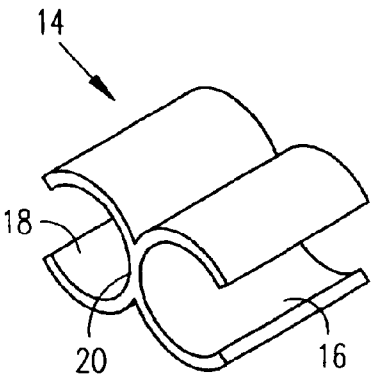
FIG. 3 is a perspective view of one form of clip, used to form the bandolier of FIG. 2*a;*

As seen in FIG. 3, a clip 14 has two generally C-shaped channels 16, 18 joined back to back by a web 20. Clip 14 is of resilient plastics material or of spring steel. The steel may be covered in plastic to reduce the risk of scratching the base of the bushing. The walls of the C-shaped channels 16, 18 subtend an angle greater than 180 degrees, preferably they are about 270 degrees, and are dimensioned to clip over the reduced diameter regions 8, 10, 12 of the engaging elements 1.

Figure 2B:
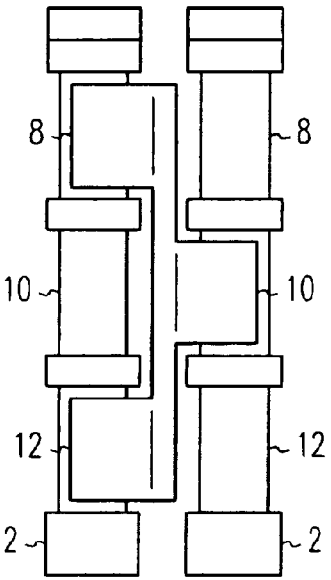
FIG. 2*b* illustrates a modification of a clip of FIG. 2.
Figure 2A:
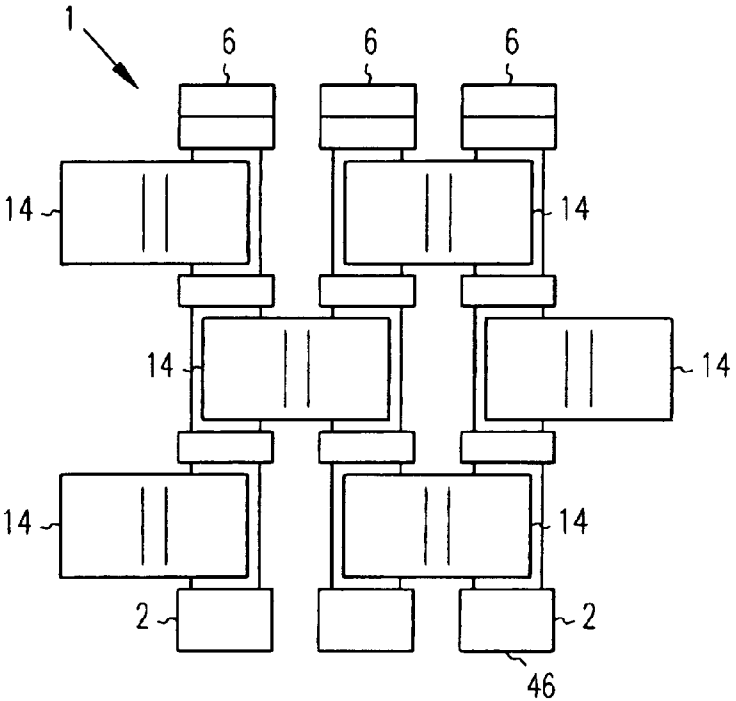
FIG. 2*a* illustrates the elements of FIG. 1 formed into a bandolier.

As seen in FIG. 2, several engaging elements are clipped together, side by side, by the clips 14; regions 8, 12 being used to connect one pair of pins, and regions 10 being used to connect the next adjacent pins, and so on.

The clips are dimensioned to hold the elements 1 reasonably tightly so that the bandolier formed by a plurality of elements will not readily flex, but will tend to hold its shape. The pin diameter at the regions 8, 10, 12 may be about four thousandths of an inch oversized relative to the channels 16, 18 to provide an interference between the parts.

FIG. 2*b* illustrates another form of the clip 14', in which the clip engages the centre portion 10 of one pin 2, and the outer portions 8, 12 of the adjacent pin.

Figure 4:
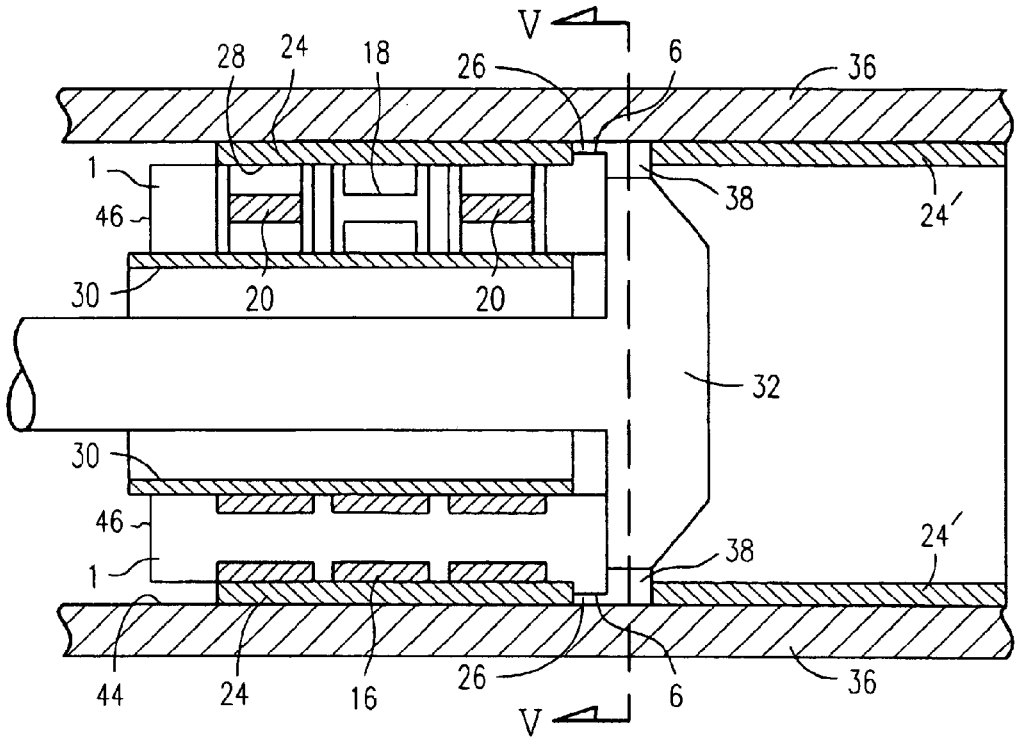
FIG. 4 is a cross-section through a bushing, showing the engaging elements in use.

In the example of FIGS. 4 and 5, a bandolier 22 of some 12 engaging elements 1 has been formed. The bandolier 22 is rolled into a spiral and then inserted into a bushing 24 so that the lips 6 are positioned beyond the distal end surface 26 of the bushing. The bandolier 22 is then expanded out by hand to press the elements 2 against the bushing inner surface 28 so that the lips 6 will overlay the end surface 26. A tube 30 is then inserted to hold the bandolier 22 in place, with the elements snug against the inner surface 28.

An extractor head 32 is then brought to bear on the end surfaces 34 of the elements 2, and is pulled in the direction of arrow A by a hydraulic or mechanical extractor (not shown) to withdraw the elements 2 and bushing 24 from the housing 36.

Extractor head 32 may be inserted through the bushing 24 before the bandolier 22 and cylinder 30 are put in place. Alternatively it could be inserted from the opposite end of the housing 36 (if the housing has a through bore) or it might have retractable claws to allow it to be fed through the tube 30.

In the example shown, the housing 36 accommodates two bushings 24, 24', and the lips 6 on the pins 2 fit within the gully 38 between the bushings 24, 24'.

To facilitate insertion of the tube 30, the engaging elements 1 may taper slightly towards the proximal end of the bushing, and/or a taper may be provided on the tube 30.

If the clips hold the pins close together, the overhanging lips 6 on the pins will limit the relative rotation of the pins. The end surfaces 46 of the pins may be marked to indicate the pin orientation. Also, the pins and clips may be flattened to hold the pins in the preferred orientation and provide some spring force to urge the engaging elements outward against the bushing.

As clearly seen from FIG. 5, a larger diameter bushing may be accommodated by adding pins 2 to the bandolier 22, and likewise a small diameter bushing by removing pins 2.

It is preferred to maximise the number of pins in order to spread the extraction force around the end surface 26 of the bushing 24.

However, to accommodate different bushing sizes, the spacing between the engaging elements 1 could be increased by increasing the width of the web 20 in the clips 14, for example.

Also different diameter pins may be provided to accommodate different ranges of bushing diameter.

Typically the main body of the pin 2 is about 8 mm diameter, and the lip 6 is formed on a diameter of about 10 mm, i.e. a 2 mm overhang.

The lip 6 is preferably at an end of the pin 2, but it may also be provided part way along the length of the pin. Also, the lip 6 may be of uniform depth, extending around the pin.

The pin is preferably cast using a lost wax system to give good definition to the pin shape, particularly in the region of the lip 6.

It is important to maintain a good overlap between the lip 6 of the pin 2 and the end of the bushing 24, and hence to keep the body of the pin 2 snug against the inner surface 28 of the bushing 24.

The sleeve 30 is provided to hold the pins 1 against the surface 28 of the bushing 24. However, when a bushing has worn it is necessary to provide a larger diameter sleeve, for example by building up the outer diameter of the sleeve with tape. However, this technique might not be rigorously followed in a workshop. Another possibility is to use a cylindrical coil spring in place of the sleeve 30. The spring can be wound about its axis to reduce the diameter of the spring for insertion into the circle of pins 2, and then released to expand out and bear on the pins.

Figure 6:
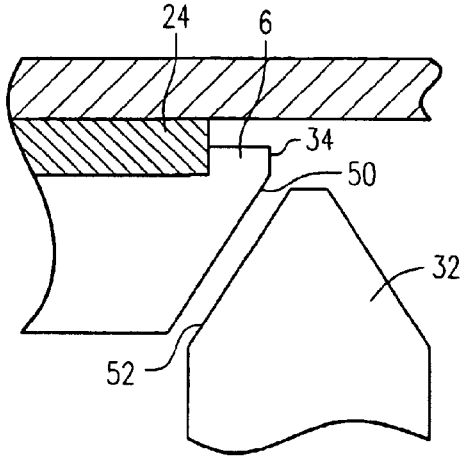
FIG. 6 is an enlarged detail of FIG. 4.

Also, the end faces 34 of the pins 2 may have a chamfer 50 and/or a chamfer 52 may be provided on the puller head 32 where the pin end 34 and puller head 32 engage, to urge the pins 2 outwardly, as shown schematically in enlarged view in FIG. 6. A chamfer angled at only a few degrees to the pin end surfaces 34 is expected to be sufficient.

It is also preferred to have a relatively long pin body extending within the bushing 24 to limit or resist any tendency of the pin to twist about its area of contact with the end of the bushing 24.

Figure 7A:
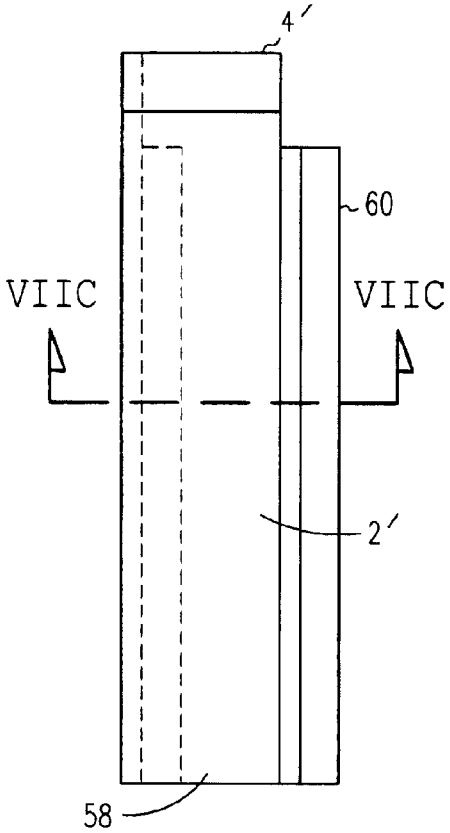
FIGS. 7*a* and 7*b* are plan and side views of another embodiment of an engaging element.
Figure 7B:
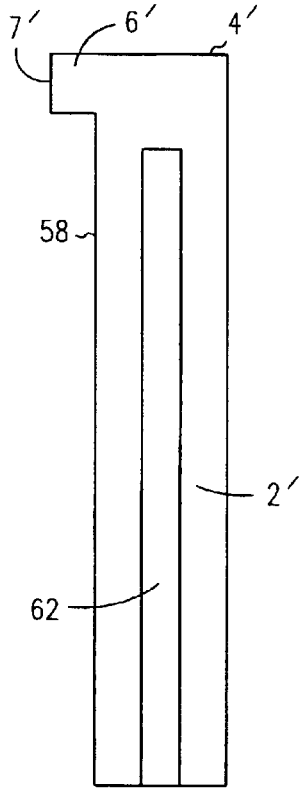
Figure 7C:
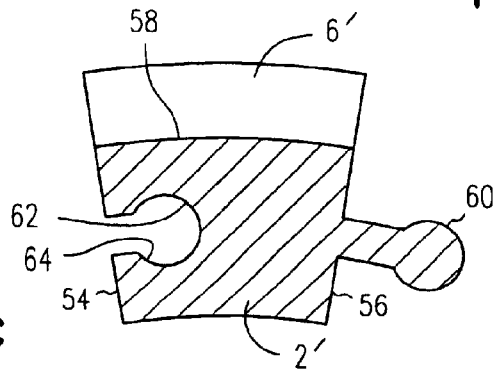
FIG. 7*c* is a cross-section along the line VIIc—VIIc of FIG. 7*a,*

FIGS. 7*a* to 7*c* show another embodiment of a pin of the invention. In this embodiment, means for releasably connecting pins together is integrally formed on each pin body. Referring to FIG. 7*c*, a pin 2' has a generally trapezium shaped cross-section formed on an annular segment, with a lip 6' extending from one end 4' of the pin 2'.

Generally radially extending sides 54, 56 converge inwardly, and a lip 6' is formed on the radially outer surface 58.

On one side 56 a key-hole shaped extension 60 is formed. This will slide in a corresponding key-hole shaped recess 62 provided in the other side 54 of an adjacent pin 2'.

The mouth 64 of the recess 62 is dimensioned to allow the projection 60 to swivel in the recess 62, thus allowing a line of pins to flex to accommodate different bushing sizes.

Figure 8A:
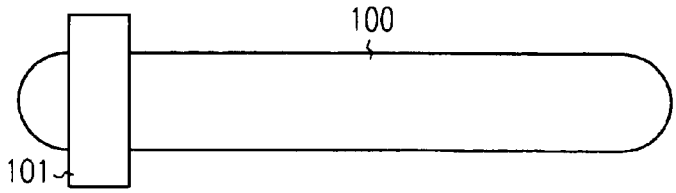
FIG. 8*a* shows a side view of another form of engaging element and FIG. 8*b* is a perspective view of another form of clip.
Figure 8B:
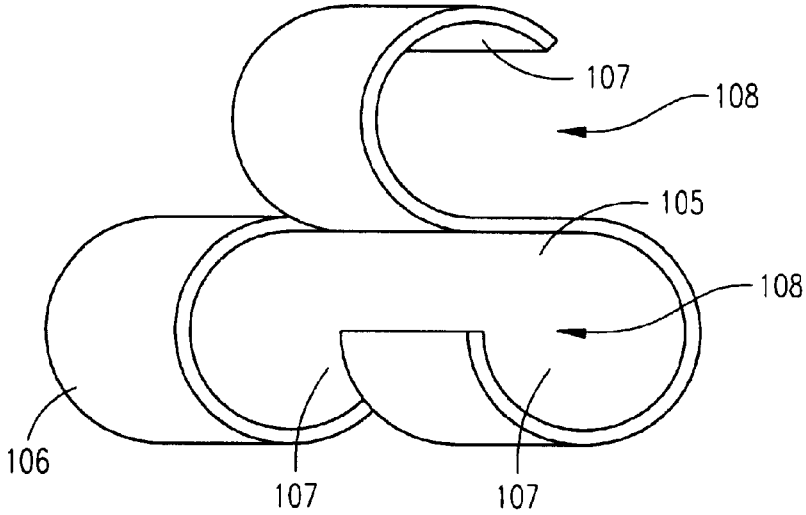
Figure 8C:
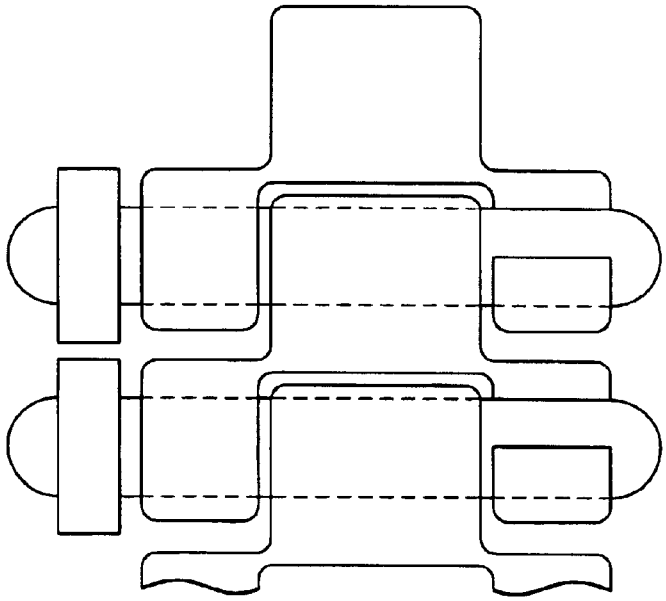
FIG. 8*c* shows a bandolier formed by the engaging elements of FIG. 8*a* and the clips of FIG. 8*b,*

Another embodiment of engaging element and clip are shown in FIGS. 8*a*–*c*. This works in the same way as the first type of engaging element and clip to extract a bushing. The engaging element is again a solid pin 100 with a generally circular cross section. A circumferential flange 101 is formed near the wide end of the pin. The engaging element may be made from toughened steel.

The clip design is similar to that shown in FIG. 3*b*. Each clip has a spine 105, attached to which are three generally C-shaped clip members 106. Each clip member 106 forms a channel 108 perpendicular to the C-shape. Each C-shaped clip member 106 is attached by its end to the spine 105, although alternatively, it could be attached by the back of the C-shape. The three clip members 106 project from the spine 105 in a row along its length. The two channels formed by the clip members at the two ends of the spine are aligned, and they are parallel to the channel formed by the middle clip member, but on an opposite side of the spine. The opening gaps 107 in the two end C-shape clip members 106 are preferably on opposite sides. The C-shaped clip members 106 subtend an angle greater than 180 degrees, preferably they are about 270 degrees, and are dimensioned to clip around the pin of the engaging elements. Preferably, the clips are spring clips, and may be made of resilient plastics material or spring steel. They may be toughened, and may be coated with a protective material. Preferably, they are made from plastics coated spring steel, where the coating prevents scratching of the bore.

Several engaging elements of this second type may be clipped together, side by side, by the clips, as shown in FIG. 8*c*. The engaging elements may be slid axially or sideways into the channels of the clips. The flange 101 on the pin 100 is preferably circular in shape, and acts as a lip to engage the bushing. The clips are dimensioned to hold the elements reasonably tightly so that the bandolier formed by a plurality of elements will not readily flex, but will tend to hold its shape.

Rather than being circular in cross section, the engaging elements and the channels of the pins may have flat areas on their surfaces. When an engaging elements are slid into channels to form a bandolier, the flat areas will tend to orient enagaging elements to give the bandolier a preferred shape.

Figure 9:
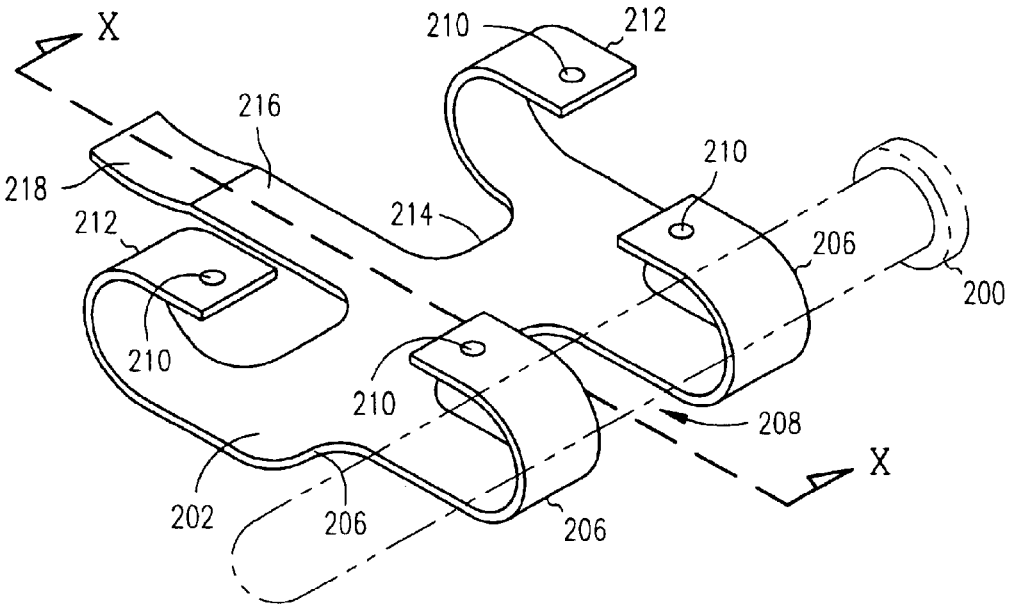
FIG. 9 is a perspective view of another embodiment of a spring clip.
Figure 10:
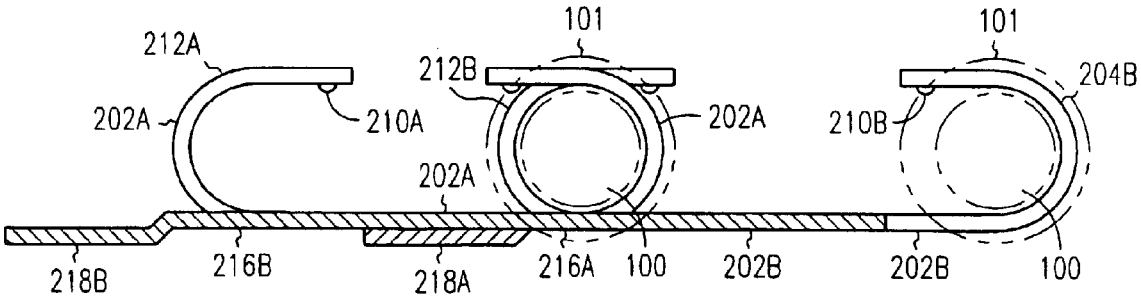
FIG. 10 is a cross-section along line X—X of FIG. 9, showing two clips and two engaging elements in position.

FIGS. 9 and 10 show another embodiment of a clip for securing the pins 100 together to form a chain or bandolier.

Referring to FIG. 9, a clip 200 is formed of spring steel and coated with plastics. A central web 202 has two U-shaped arms 204 extending to one edge 206, spaced apart by a gap 208. A pin 100, shown in dotted outline, clips into the arms 204, or may be slid in axially. Arms 204 grip the pin 100 and nibs 218 (see FIG. 10) also serve to hold the pin 100 in place.

Two further U-shaped arms 212 extend from the opposite edge 214 of web 202. Arms 212 are spaced apart to sit either side of the pair of arms 204 of an adjacent like clip. A central tongue 216 formed in the plane of web 202 is positioned centrally of arms 212 and will extend into the gap 208 of a like adjacent clip. Nibs 210 are also provided on arms 212.

The outer end 218 of tongue 216 is stepped below the plane of web 202, so that it will sit below the web 202 of a like adjacent clip (see FIG. 10).

In use, a pair of clips 200 can be brought together, the arms 204 of one clip sitting between arms 212 of the adjacent clip, and the end portion 218 of tongue 216 sitting beneath web 202. A pin 100 is then slid axially into the space defined between the oppositely facing arms 204, 212. Alternatively, a pin 100 can be clipped into one set of arms 204, or 212, and the arms of the other clip then clipped over the pin 100.

Referring to FIG. 10, two clips 202 are shown and distinguished by suffices a and b.

Referring to FIG. 10, the tongue 216, 218 will tend to resist bending of a row of clips 200 and pins 100. Nevertheless, tongue 218 is of spring steel, and so a bandolier can be bent against the force of the tongues 216, 218 to form a curl which can be inserted in a bush, tongues 216, 218 tending to straighten the curl and to urge the pins 100 outwards against the bush inner surface.

Other modifications may be apparent to those in the art and it is desired to include all such modifications as fall within the scope of the accompanying claims.

I claim:

1. An engaging device for engaging an end of a bushing prior to extraction of the bushing from a housing, the device comprising a plurality of engaging elements each having a laterally extending lip thereon, and a connector for releasably connecting the elements together, wherein the connected elements form a chain which is flexible to allow the chain to be rolled up for insertion in a bushing, and unrolled to place the elements against the bushing inner surface.

2. An engaging device, as claimed in claim 1, wherein the engaging elements are elongate.

3. An engaging device as claimed in claim 1, wherein the connector resiliently grips an element.

4. An engaging device as claimed in claim 3, wherein the connector is rotatable about an engaging element.

5. An engaging device for engaging an end of a bushing prior to extraction of the bushing from a housing, the device comprising:

a plurality of engaging elements each having a laterally extending lip thereon, a connector for releasably connecting the elements together, an engaging element formed by a generally cylindrical pin, and wherein the connector comprises an arcuate cross-section channel for receiving a pin to resiliently grip the pin, the connector being rotatable about the pin.

6. An engaging device for engaging an end of a bushing prior to extraction of the bushing from a housing, the engaging device comprising a plurality of pins, a first pin of the plurality of pins includes a projection, a second pin of the plurality of pins includes a recess adapted to receive the projection, the first and second pins being connected together by the projection engaging in the recess, and the first and second pins having a laterally extending lip for engaging an end of the bushing.

7. An engaging device, as claimed in claim 6, wherein each pin comprises a flange.

8. An engaging device as claimed in claim 6, wherein the lip is provided at an end of the pin.

9. An engaging device as claimed in claim 6, wherein each pin has a recess and a projection.

10. An engaging device, as claimed in claim 9, wherein each pin comprises a flange, and wherein the lip is provided at an end of each respective pin.

11. An engaging device, as claimed in claim 9, wherein each pin is connected to an adjacent one of the plurality of pins by the projection engaging the recess.

12. A method of extracting a bushing from a housing, the method comprising:

selecting a plurality of separately formed engaging elements to match a diameter of a bushing;

releasably clipping together adjacent ones of the plurality of separately formed engaging elements such that a lip, adapted to engage an end surface of the bushing, extends outwardly;

placing the clipped together engaging elements within the bushing; and applying pressure to ends of the elements such that the lips transfer the pressure to the end surface of the bushing to force the bushing from the housing.

13. A method as claimed in claim 12, wherein the engaging elements are flexibly clipped together.

14. A method as claimed in claim 12, wherein a former is inserted into the bushing to hold the engaging elements in place.

15. The method of claim 12, wherein releasably clipping together adjacent ones of the plurality of separately formed engaging elements includes holding the clipped together engaging elements at a fixed distance from each other.

16. The method of claim 15, wherein holding the clipped together engaging elements at a fixed distance from each other includes holding the clipped together engaging elements parallel to each other.

17. The method of claim 16, wherein placing the clipped together engaging elements within the bushing includes rolling the clipped together engaging elements into a spiral and then inserting the spiral into the bushing.

* * * * *